US007740069B2

(12) United States Patent
Young

(10) Patent No.: US 7,740,069 B2
(45) Date of Patent: Jun. 22, 2010

(54) PROCESS FOR TWO-STEP FRACTURING OF SUBSURFACE FORMATIONS

(76) Inventor: Michael Roy Young, 3881 Deer Trail La., Danville, CA (US) 94506

( * ) Notice: Subject to any disclaimer, the term of this patent is extended or adjusted under 35 U.S.C. 154(b) by 176 days.

(21) Appl. No.: 11/969,802

(22) Filed: Jan. 4, 2008

(65) Prior Publication Data

US 2008/0164030 A1 Jul. 10, 2008

Related U.S. Application Data

(60) Provisional application No. 60/878,356, filed on Jan. 4, 2007.

(51) Int. Cl.
*E21B 43/263* (2006.01)

(52) U.S. Cl. ..... 166/299; 166/300; 166/308.1; 166/308.2

(58) Field of Classification Search ..... None
See application file for complete search history.

(56) References Cited

U.S. PATENT DOCUMENTS 3,270,815 A * 9/1966 Osborn et al. ..... 166/299
3,834,955 A * 9/1974 Fox et al. ..... 149/7
4,039,030 A * 8/1977 Godfrey et al. ..... 166/299
4,081,031 A 3/1978 Mohaupt
4,490,196 A * 12/1984 Funk ..... 149/92
4,548,252 A * 10/1985 Stowe et al. ..... 166/299
4,683,951 A * 8/1987 Pathak et al. ..... 166/271
4,685,375 A 8/1987 Ross et al.
4,718,493 A * 1/1988 Hill et al. ..... 166/308.1
4,823,875 A * 4/1989 Hill ..... 166/280.1
5,505,800 A 4/1996 Harries et al.
5,551,344 A * 9/1996 Couet et al. ..... 102/312
6,261,393 B1 7/2001 Vestre (Continued)

OTHER PUBLICATIONS

McCune, Dwayne, and Schmidt, Richard J., Application of the GasGun™ in Kansas Oil and Gas Operations, Petroleum Technology Transfer Council, Feb. 2003, http://www.kgs.ku.edu/PTTC/Case_Studies/Gasgun/index.html.

(Continued)

*Primary Examiner*—George Suchfield
(74) *Attorney, Agent, or Firm*—Brian Beverly; Beeson Skinner Beverly

(57) ABSTRACT

A process for in situ production of shale oil comprises fracturing the target zone 10 of an shale oil formation using a two step approach. First, an initial set of fractures 18 is developed in the formation by using high pressure gas pulses. Second, a secondary set of fractures 28 extending and further fracturing the initial set of fractures 18 is created using a modified ANFO mix 22 wherein rubber particles acting as solid fuel are blended in with ammonium nitrate and fuel oil. The solid fuel enhances the fracturing characteristics of ANFO while minimizing its crushing and compacting tendencies. Hot high pour point oil is then injected into the formation and forced into the receptor well 16 where it is pumped to the surface. By circulating oil in the formation at carefully controlled temperatures, kerogen can be decomposed at the optimum rate to maximize the amount of oil recovered and yield high quality shale oil. High pour point oil reaching cooler extremities of the fractured formation will solidify creating an impermeable perimeter barrier 34 around the target zone 10.

7 Claims, 1 Drawing Sheet

U.S. PATENT DOCUMENTS 7,073,589 B2 * 7/2006 Tiernan et al. ..... 166/308.2

OTHER PUBLICATIONS

Schmidt, R.A., Boade, R. R., and Bass, R. C., "A New Perspective on Well Shooting—Behavior of Deeply Buried Explosions and Deflagrations," Jul. 1981, Journal of Petroleum Technology, vol. 33, No. 7, pp. 1305-1311.

U.S. Department of Interior, Bureau of Land Management, "Environmental Assessment, CO-110-2006-120-EA," Nov. 2006, http://www.blm.gov/content/etc/medialib/blm/co/field_offices/white_river_field/oil_shale/chevron_u_s_a_inc.Par.26834.File.dat/CO1102006120EAwofigures.pdf.

* cited by examiner

PROCESS FOR TWO-STEP FRACTURING OF SUBSURFACE FORMATIONS

CROSS-REFERENCE TO RELATED APPLICATION

This application claims the benefit of U.S. Provisional Application No. 60/878,356, filed Jan. 4, 2007.

BACKGROUND OF THE INVENTION

1. Field of the Invention

The invention is directed to a process for fracturing a tight subsurface formation, and more particularly to a two-step process for fracturing an oil shale formation for production of shale oil.

2. Description of the Prior Art

Historically, pathways in hydrocarbon formations have been created using high explosives, hydraulic fracturing techniques, and acid treatments. Research has shown that the pressure pulse created by high explosives enlarges the well bore by crushing and compacting the surrounding rock in the formation. The enlarged well bore is left with a zone of residual compressive stress and compacted rock which can actually reduce permeability near the well bore. Extensive caving also occurs in the well bore leaving debris that may require days or even weeks to clean up. Hydraulic fracturing is highly effective but is well known to create fractures that can break out of a producing formation and into nearby aquifers.

A more recently available alternative used for fracturing a tight formation surrounding a well bore is the use of high pressure gas pulses, sometimes referred to as high energy gas fracturing. This involves activating a solid propellant, often referred to as a low explosive, to generate high-pressure gas pulses that are strong enough to create multiple fractures in the adjacent formation radiating 10 to 100 feet from the well bore, but not so strong as to pulverize and compact the rock such as is the case with high explosives. It is sometimes explained that these solid propellants do not detonate supersonically, but deflagrate at subsonic velocities. Several advantages of high-pressure gas pulse technology are that cavings are minimal, the integrity of the well bore is maintained, and clean up is nominal. The nature of the forces produced by gas pulses also has the salutary effect of creating fractures having minimal vertical propagation thereby lessening the chances of breaking into adjacent aquifers.

Ammonium-nitrate fuel oil (ANFO) is one of a class of high explosive compositions which includes an oxidizing agent and a liquid hydrocarbon component. Ammonium-nitrate is by far the preferred oxidizing agent and #2 fuel oil is usually the liquid hydrocarbon of choice. ANFO may be modified to reduce the shock energy and increase the heave energy of the explosion. ANFO so modified, commonly known as a low shock energy explosive, has been used in quarrying operations in rock blasting situations, but has never been used for fracturing oil shale formations.

It is critically important to avoid contamination of aquifers located in proximity to the targeted portion of the formation. The vertical fracturing which results from hydraulic fracturing techniques can intersect natural vertical fractures in the formation creating pathways to aquifers usually located in horizontal strata above or below a target formation.

BRIEF DESCRIPTION OF THE ILLUSTRATIONS

DETAILED DESCRIPTION OF THE ILLUSTRATED EMBODIMENTS

A process for two-step fracturing of a tight subsurface formation, such as an oil shale formation, comprises a series of steps each of which is discussed in detail below in relation to the attached drawings.

Figure 1:
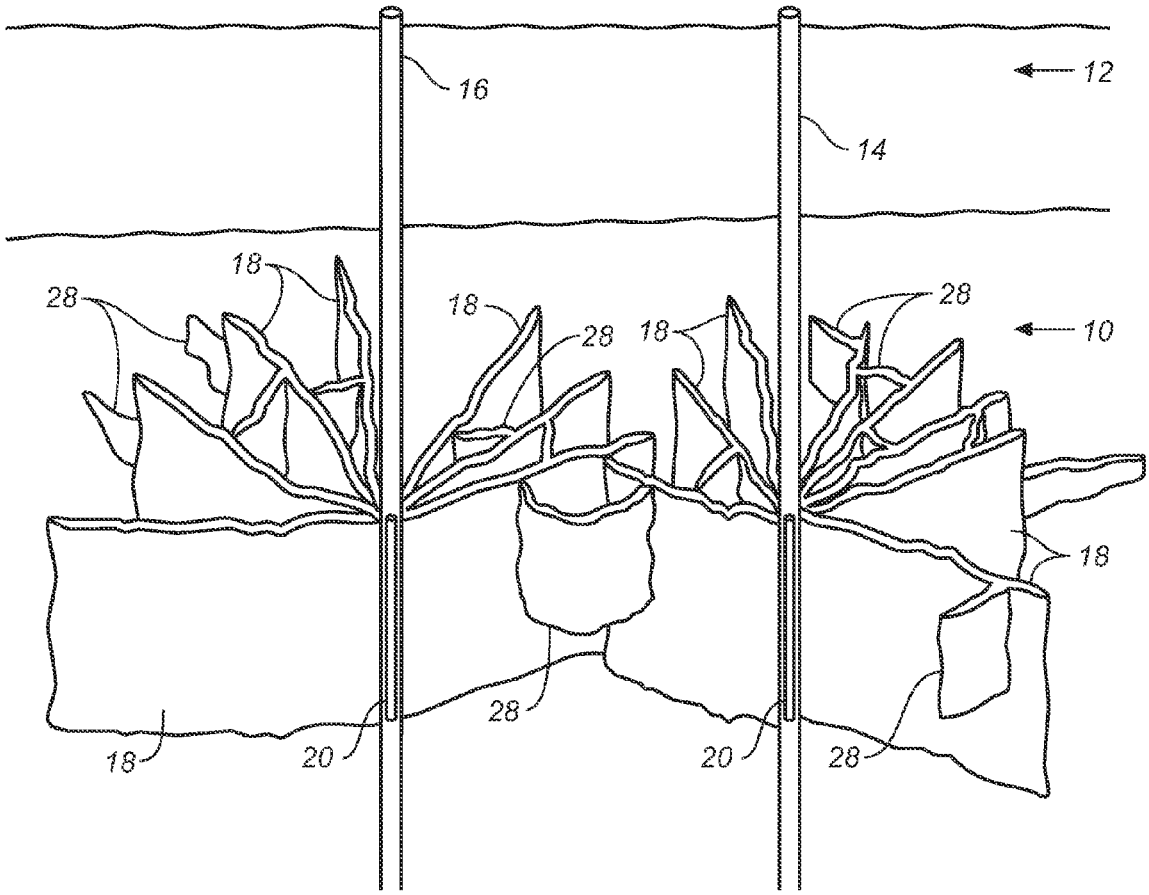
FIG. 1 is a perspective view of the target zone of a subsurface formation in which two wells have been drilled and initial (18) and secondary (28) sets of fractures have been created.
Figure 2:
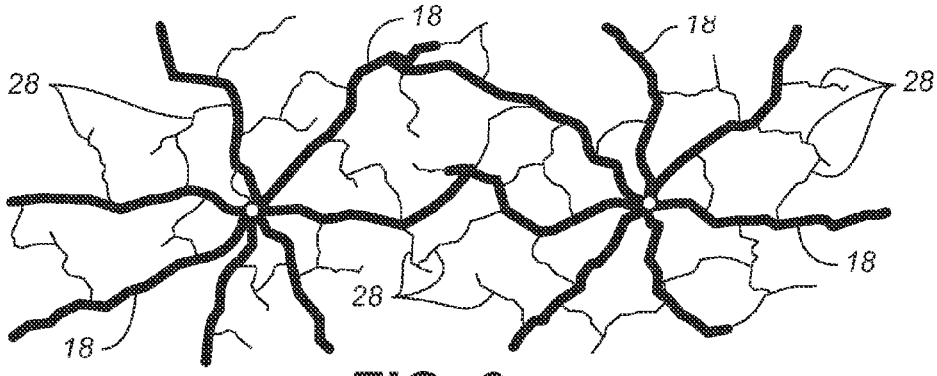
FIG. 2 is a plan view of a horizontal section of the target zone depicted in FIG. 1 showing the initial and secondary sets of fractures.

With reference to FIGS. 1 and 2, the initial step is to drill sets of open hole completion wells 14, 16 into the target zone 10 of an identified shale formation below an overburden 12 to targeted depths. Identification of the location of a shale formation and focus therein on a target zone are matters well understood by those of skill in the art.

Next an initial set of fractures 18 is created by generating high pressure gas pulses each well 14, 16. Individual charges 20 of solid propellant are lowered into the wells and positioned in the target zone 10. Charges 20 are characteristically formed into long cylindrical shapes and are customarily approximately ten feet long. Several charges 20 may be positioned one on top of the other according to the specified depth of the formation to be fractured. Once the charge or charges are in place, they are detonated one-by-one at decreasing depths to create a network of fractures 18 in the target formation 10 in a pattern radiating from the well bores 14, 16 for up to twenty to twenty-five feet. A common characteristic of fractures created by generation of high pressure gas pulses in this manner is that the fractures have a vertical dimension roughly equivalent to the height, or long dimension, of the charge 20, while having a very much narrower width of perhaps one-eighth of an inch. Thus, if a single ten foot long charge 20 is detonated, the resulting fractures may have an approximate height of ten feet, an approximate width of one-eighth of an inch, and radiate out from the well bore for perhaps twenty to twenty-five fee. Consequently, there is a considerable amount of vertical interconnection between individual fractures throughout the initial set of fractures 18 although this is not particularly shown in the illustrations. Ideally, the fractures 18 extending from adjacent wells overlap and interconnect to establish communication pathways for the flow of fluids and gases. If a string of several charges 20 is detonated, the fractures created by each charge will tend to link up vertically.

Following creation of the initial set of fractures 18, a secondary set of fractures 28 is developed. To this end a modified ANFO explosive composition is prepared by adding a particulate solid fuel to the basic composition of ANFO components discussed above. Solid fuel increases the rock splitting capabilities of the new explosive composition by slowing the release of energy upon detonation; thus reducing the shock energy and increasing the heave energy of the explosion similar to the explosive signature of high pressure gas pulses. Rubber particles are the preferred choice of solid fuel. Alternatives include, however, gilsonite, unexpanded polystyrene in solid form, acrylonitrile-butadiene-styrene (ABS), waxed wood meal, rosin, and certain non-absorbent carbonaceous materials. The rubber may be selected from natural rubbers, synthetic rubbers, or combinations thereof.

Post-detonation detection devices, such as geophones, are first used to determine the location of the initial set of fractures 18. Primary explosive charges are then positioned in the well bores adjacent the target zone 10 for detonating the modified ANFO 22. In one aspect of the invention, advantage is taken of the primary explosive charges by positioning them as near as possible to bedding planes marking transition points between stratigraphic layers in the formation. By placing the charges adjacent these inherently weak points in the formation, additional fracturing should result upon detonation and, conversely, any tendency to pulverize the surrounding formation should be reduced. The modified ANFO solution, blended in the correct proportions to be explosive, is then injected into both wells 14, 16. Therefrom, it flows into the initial set of fractures 18. Finally, the wells 14, 16 are tamped or pressured and the charges detonated to, in turn, activate the modified ANFO. The liquid ANFO mix, having penetrated into the initial set of fractures 18, will upon detonation create a relatively dense set of secondary fractures 28 some portion of which extend generally perpendicularly from the initial set of fractures 18, some of which may extend the reach of the initial fractures, and some of which will extend directly from the well bore wall. The secondary set of fractures 28 tends further to break and "rubblize" the formation because of the generally vertical nature of the profile of the initial set of fractures 18, creating thereby an expanded network of interconnections between the adjacent wells 14, 16. Use of the modified ANFO mix in concert with high pressure gas pulses improves fracturing capabilities thereby facilitating use of such methods at greater depths in the formation. Most evidently, infusing modified ANFO in the formation, initially fractured by application of high pressure gas pulse technology, increases the volume of the explosive which can be used, resulting in a significant increase in the volume of the formation that is fractured. Moreover, more uniform fracturing results and fewer oil shale fines are created.

In one embodiment of the invention sand may be added to the modified ANFO mixture for two purposes. First, it is thought that sand acts as a heat sink during the explosion, thus helping to shift some of the shock energy of the explosion to heave energy. Second, sand particles may help prop open the network of fractures created according to the invention.

If water is present in the target zone, it may be necessary to use water-thickening or water-resistant ANFO mixtures. For example, if natural fractures are encountered in the formation which may lead to an aquifer, water-thickening agents may be added to the ANFO mix that will form an impermeable paste impeding leakage of the explosive out of the target zone. Alternatively, an ANFO mixture having water-resistant properties may be used if water is present in the target formation but there is no risk of contaminating adjacent aquifers.

It will be readily understood by those of skill in the art that the above-described method of creating initial and secondary fracturing need not be restricted to oil shale formations and can be applied to any tight formation.

There have thus been described certain preferred embodiments of a process for two-step fracturing of subsurface formations. While preferred embodiments have been described and disclosed, it will be recognized by those with skill in the art that modifications are within the true spirit and scope of the invention. The appended claims are intended to cover all such modifications.

I claim:

1. A process for two-step fracturing of a subsurface formation comprising:

drilling at least one well into a target zone of the formation, said at least one well having a well bore, generating one or more high pressure gas pulses in said well bore to create an initial set of fractures in said target zone, injecting into said initial set of fractures an explosive composition including an oxidizing agent, a liquid hydrocarbon component, and a solid fuel material in particulate form, said explosive composition for producing a low shock energy explosion, and detonating said explosive composition to create a secondary set of fractures, a portion of said secondary set of fractures extending from said initial set of fractures.

2. The process for two-step fracturing of a subsurface formation of claim 1 wherein:

said target zone contains oil shale.

3. The process for two-step fracturing of a subsurface formation of claim 1 wherein:

said one or more high pressure gas pulses are generated by deflagrating a solid propellant.

4. The process for two-step fracturing of a subsurface formation of claim 1 wherein:

said oxidizing agent comprises ammonium-nitrate.

5. The process for two-step fracturing of a subsurface formation of claim 1 wherein:

said liquid hydrocarbon component comprises fuel oil.

6. The process for two-step fracturing of a subsurface formation of claim 1 wherein:

said solid fuel material in said explosive composition comprises rubber particles.

7. The process for two-step fracturing of a subsurface formation of claim 1 wherein:

said explosive composition includes sand.

* * * * *

UNITED STATES PATENT AND TRADEMARK OFFICE

CERTIFICATE OF CORRECTION

PATENT NO. : 7,740,069 B2
APPLICATION NO. : 11/969802
DATED : June 22, 2010
INVENTOR(S) : Michael Roy Young It is certified that error appears in the above-identified patent and that said Letters Patent is hereby corrected as shown below:

Col. 2, line 28, --in-- should be inserted between "pulses" and "each."
Col. 3, line 8, "22" should be deleted after "ANFO."

Signed and Sealed this

Twenty-sixth Day of October, 2010

David J. Kappos

David J. Kappos
*Director of the United States Patent and Trademark Office*